United States Patent [19]

Roth

[11] Patent Number: 4,481,411

[45] Date of Patent: Nov. 6, 1984

[54] ELECTRICAL HEATER RACK ASSEMBLY WITH STAND-OFF INSULATORS

[75] Inventor: James E. Roth, DeSoto, Mo.

[73] Assignee: Intertherm Inc., St. Louis, Mo.

[21] Appl. No.: 564,001

[22] Filed: Dec. 21, 1983

[51] Int. Cl.[3] ..... H05B 3/06

[52] U.S. Cl. ..... 219/532; D13/18; 174/175; 219/536; 219/542; 219/550; 338/299

[58] Field of Search ..... 219/374, 375, 532, 536, 219/537, 542, 546, 550; 174/138 J, 175, 212; 338/299, 304, 320; D13/17, 18, 3; 373/130

[56] References Cited

U.S. PATENT DOCUMENTS

| | | | |
|---|---|---|---|
| D. 251,260 | 10/1981 | Seeley | D13/3 |
| D. 262,285 | 12/1981 | Janning | D13/18 |
| 2,856,500 | 10/1958 | Hartman | 219/536 |
| 2,927,956 | 3/1960 | Reisch | 174/138 J |
| 3,952,409 | 4/1976 | Allison et al. | 29/611 |
| 3,992,609 | 11/1976 | Alexander | 219/532 |
| 4,250,399 | 2/1981 | King | 219/532 |
| 4,268,742 | 5/1981 | Cottrell et al. | 219/532 |
| 4,363,959 | 12/1982 | Cottrell et al. | 219/532 |

*Primary Examiner*—Volodymyr Y. Mayewsky
*Attorney, Agent, or Firm*—Jerome A. Gross

[57] ABSTRACT

A heater rack assembly, of the type which supports an electric heating coil in a pattern of parallel rows in a plane, utilizes double-ended stand-off insulators which are formed wafer-like in the plane. The insulators have, at each end, pairs of hook portions facing each other to provide a throat, which opens into a wire-accommodating slot behind the hook tips, the slot converging toward the center at an angle of 150° or less. Adjacent turns of the coil are to be accommodated within the slot. Its convergence retains within the slot adjacent coil turns which might otherwise escape, requiring for such escape what is in effect a reverse in-plane twisting displacement.

1 Claim, 4 Drawing Figures

ELECTRICAL HEATER RACK ASSEMBLY WITH STAND-OFF INSULATORS

TECHNICAL FIELD

The present invention relates to insulators utilized to hold closely adjacent coils of a coiled wire electric heating element.

BACKGROUND ART

This invention relates to stand-off insulators supported by a frame to hold coiled wire electric heating elements. A typical use is to support such heating element in a plane, sometimes in parallel rows connected by reversing 180° bends, so that both ends of a symmetrical insulator are employed.

Such insulators heretofore known are of several types. In a first type, the insulator tip or tips generally resembles an arrowhead, with hook-like projections on each side. When two adjacent turns of wire are pressed over the arrowhead projection, they are to spread apart and engage themselves behind the hook-like projections. In the other type, a throat is provided with a cross-slot; two adjacent turns of the coil are pressed together so that when released they are to spread apart toward the opposite ends of the slot. Both such types, as well as others, are shown in U.S. Pat. No. 4,363,959 to Cottrell et al.

Wire of types commonly used to form such coiled resistance elements may not be uniformly elastic, and further tends to lose elasticity with heating in use. Typically, heater element coils are formed by coiling with the successive turns of the coil in contact with each other; then tension is applied to their ends to stress the coils beyond their elastic limit and extend each to a desired length. This procedure does not assure that the turns of the coil will be equally spaced. Further, on assembly it is not practical to apply a fixed number of turns of the coil to the spacing of the stand-off insulators. One cannot therefore suspend the coiled wire with a chosen pre-tension between adjacent insulators; and any tension initially applied may be relieved on subsequent heating.

As a result of these factors, if a coil is mounted upon the arrowhead type insulator by adjacent turns whose spacing is greater than contemplated, its retention will not be secure. Similarly if the turns are spaced more closely than contemplated, they will be insecure if spaced on the throat-and-slot type insulator.

The spacing problem is compounded where the insulators are to be positioned not only in straight runs, but also adjacent to substantial angular bends of the heating coil. On the inside of a 180° bend, adjacent coil turns should have their spacing decreased, while it should increase on the outside of the turn. In fact, the spacing at the turns has proved to be almost unpredictable. If initial tension does not draw the "straight run" portion of the coil tightly, both the inside and outside bends, measured along the end insulators, will tend to be less than 180°, so that two adjacent coil turns, intended to be held within the throat of an insulator, will tend to disengage by virtue of this departure from rectilinear alignment. On the other hand, excess tension in the coil will itself distort the angularity of the coil turn which (normally that turn closer to the 180° bend) will be closer to its distorted position than would be contemplated by the design engineer.

DISCLOSURE OF THE INVENTION

The principal purposes of the present invention are to provide, for mounting a coiled wire heating element whose coil spacing may vary from a theoretical ideal, a stand-off insulator of such configuration that adjacent turns of the coil cannot escape from it without a substantial angular twisting displacement in the plane of the insulator, and in which the configuration of the insulator itself resists such angular displacement and tends to cam the coils back to their design position.

A still further purpose is to provide a heater rack including a plurality of identical double-ended stand-off insulators in parallel rows, supporting a continuous heating coil mounted thereon with reversing 180° outside and inside tends.

To achieve those purposes, and others which appear from this disclosure, I provide a stand-off insulator preferably of the type mounted at a central cross-axis of symmetry, and having, at each end of a longitudinal axis of symmetry, hook prongs facing each other, to provide between them an axial throat. At the inward end of the throat are linear slots, extending behind the hook prongs, which slots converge at the longitudinal axis of symmetry at an angle of substantially 150° or less, pointing toward the central mounting axis. The forward sides of these converging slots define the rear surfaces of the hook portions; while the aft sides of the slots define bearing surfaces of the body portion of the insulator.

If the two adjacent coil windings to be supported by the insulator are so close as to create a danger of the escape of one of them through the throat, the present invention prevents such escape without a substantial angular twisting displacement of the coil portion. Assuming, for example, that without angular displacement a mere longitudinal displacement of the coil portions is initiated, that coil turn approaching the throat will, in the present invention, be thrust aft by the slant of the rear surface of the hook portion; while the same longitudinal displacement causes the adjacent coil turn, at the opposite side of the axis of symmetry of the insulator, to be thrust forward. This is in effect an angular or twisting displacement, which will be resisted by the next adjacent portions of the coil on both sides. The resistance to twist so afforded provides security against escape of a coil turn through the throat of the insulator.

THE DRAWINGS

BEST MODE FOR CARRYING OUT THE INVENTION

Figure 1:
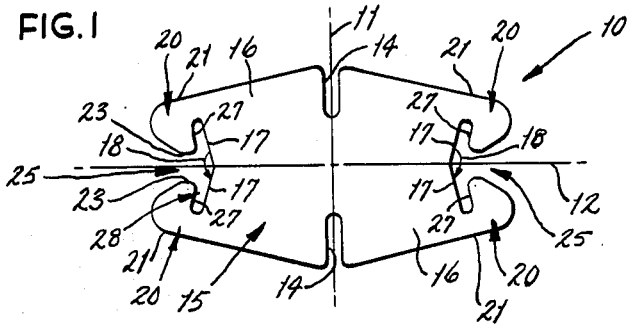
FIG. 1 is a plan view of a stand-off insulator embodying the present invention.

A preferred form of stand-off insulator embodying the present invention, generally designated 10, is of the double-ended type, having a transverse axis of symmetry 11 and a longitudinal axis of symmetry 12 perpendicular thereto. Along its transverse axis 11 it has means for mounting onto a rack frame, here being the simple inward directed slots 14.

The insulator may be defined as having a body portion generally designated 15 including an inward supporting part 16 on each side of the transverse axis of symmetry 11 and extending to linear abutment edges 17 converging toward each other at the longitudinal axis of symmetry 12 and there meeting at an angle of convergence 18 here shown to be 150° or less. The linear abutment edges 17 terminate, spacedly away from the longitudinal axis of symmetry 12, in hook-like projections generally designated 20. These have outer edges 21 which are a continuation of the outer edges of the body portion 15 and slope toward the longitudinal axis 12. At their extremities most outward from the transverse axis of symmetry 11, the hook-like projections are rounded back to provide inner edges 23 facing each other on opposite sides of the longitudinal axis of symmetry 12, thus providing a throat generally designated 25. The throat 25 terminates in linear hook rear edges 27 which are parallel to and spaced from the linear abutment edges 17, together defining an angled slot generally designated 28, of a width sufficient to accommodate the diameter of the wire of the heating coil to be described.

Figure 3:
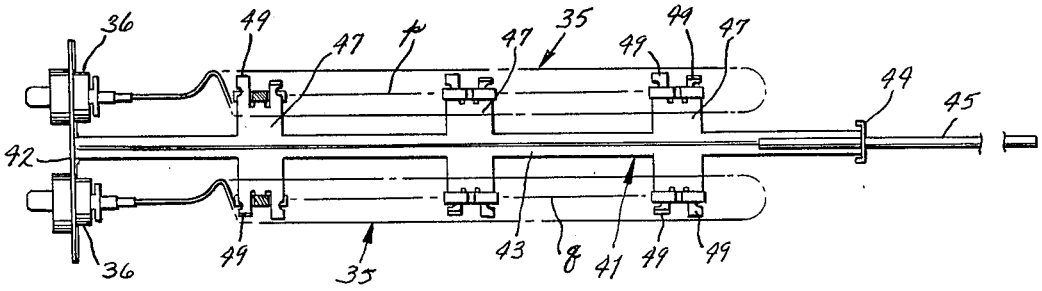
FIG. 3 is an end view thereof, showing the insulator at the left partly broken away.

The insulator 10 is relatively flat, its thickness as shown in FIG. 3 is preferably about ¼ of its width at its widest point. Some of its edges may be provided with small chamfers, not shown, for better handling in manufacture.

Figure 2:
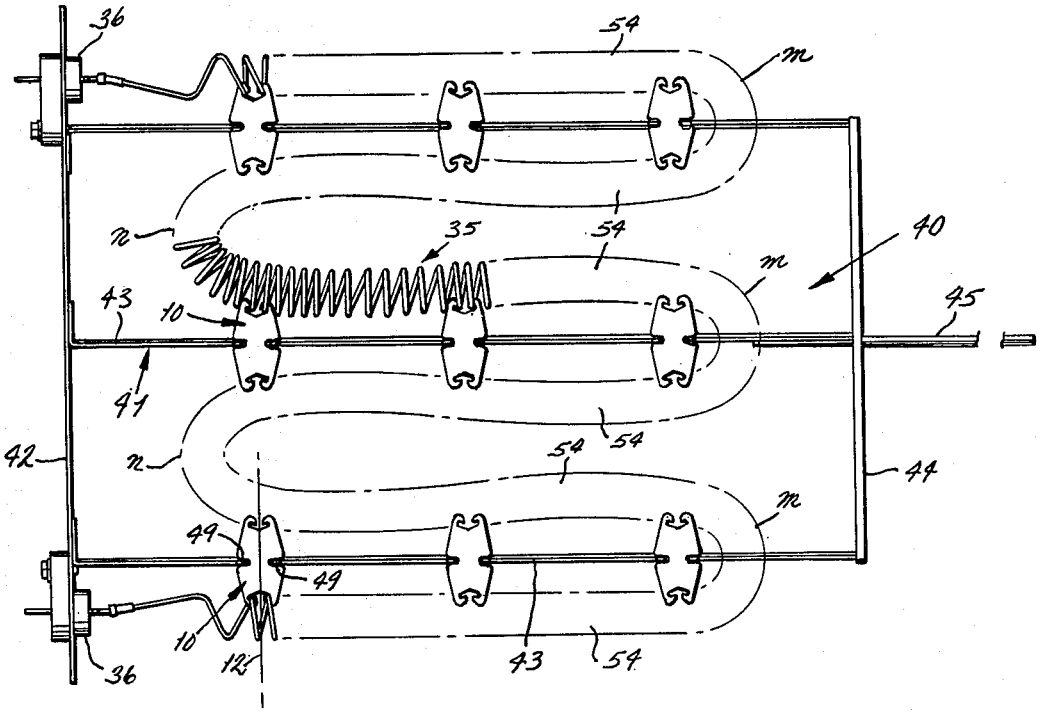
FIG. 2 is a plan view of a heater rack assembly incorporating a plurality of insulators of the type shown in FIG. 1 mounted on a conventional planar frame.

Referring now to FIGS. 2 and 3, a heater rack assembly generally designated 40 includes a support frame, itself generally designated 41, a plurality of the insulators 10 heretofore described, mounted in parallel upper and lower rows, upper and lower heating coils generally designated 35, and upper and lower terminal bushings 36 mounted in a front mounting plate 42. The support frame 41 preferably includes a plurality (here three) of bars 43 extending in a horizontal plane perpendicularly away from the plate 42 and terminating in a cross support 44, parallel to the mounting plate 42. From the cross support 44 extends a center support rod 45, which locates and aids in mounting the heater rack assembly in a conventional electric furnace not shown.

On each of the bars 43 are preferably integral vertical support plate portions 47. These are generally rectangular, but have pairs of vertically extending spaced-apart tangs 49 along their upper and lower edges. As seen in the plan view, FIG. 2, these tangs 49 extend through the slots 14 of the insulators 10; beyond them the tangs 49 are bent sideways to secure the insulators 10 in common upper and lower planes p, q, at equal distances above and below the support bars 43, in FIG. 3.

Referring again to FIG. 3, the upper and lower heating coils 35 have uncoiled portions only at their ends which connect through the terminal bushings 36. Otherwise, they extend in generally parallel rows 54, in the planes p, q; these rows, as seen in the plan view, FIG. 2, are spaced on both sides of the bars 43, and all intermediate run portions are connected by substantially 180° outside and inside bends m, n. Each of the coils 35 is thus supported in planes p, q, common to the relatively flat insulators 10.

Ideally the turns of the coil 35 would be readily mountable with an equal number of coil turns between equally spaced insulators 10; and would have such elasticity as to permit easy mounting in the insulators 10 without counting the turns of the coil, which elasticity continued despite alternate cycles of heating and cooling. Under these ideal conditions two adjacent coil turns inserted into the insulator throat 25, would spread apart the length of the slot 28, that is, to the spacing between the hook-like projections 20, exerting compressive resistance thereagainst, while adjacent coil turns on both sides would exert a tension force. Unfortunately these ideal conditions are not always present. After forming the heating element coils 35 by coiling with successive turns in contact with each other, when they are stretched apart to a permanent set, they are not at a desired uniform spacing slightly greater than the slot length 28. Instead, the coil turns will be found to be unequally spaced; to count coil turns while mounting them on the insulators would be therefore futile. In any event, subsequent heating and cooling robs the coils 35 of much of their residual elasticity. Accordingly, there is a danger that the coil turns will escape from a standoff insulator, both at the time of original mounting, and during subsequent handling and use.

Figure 4:
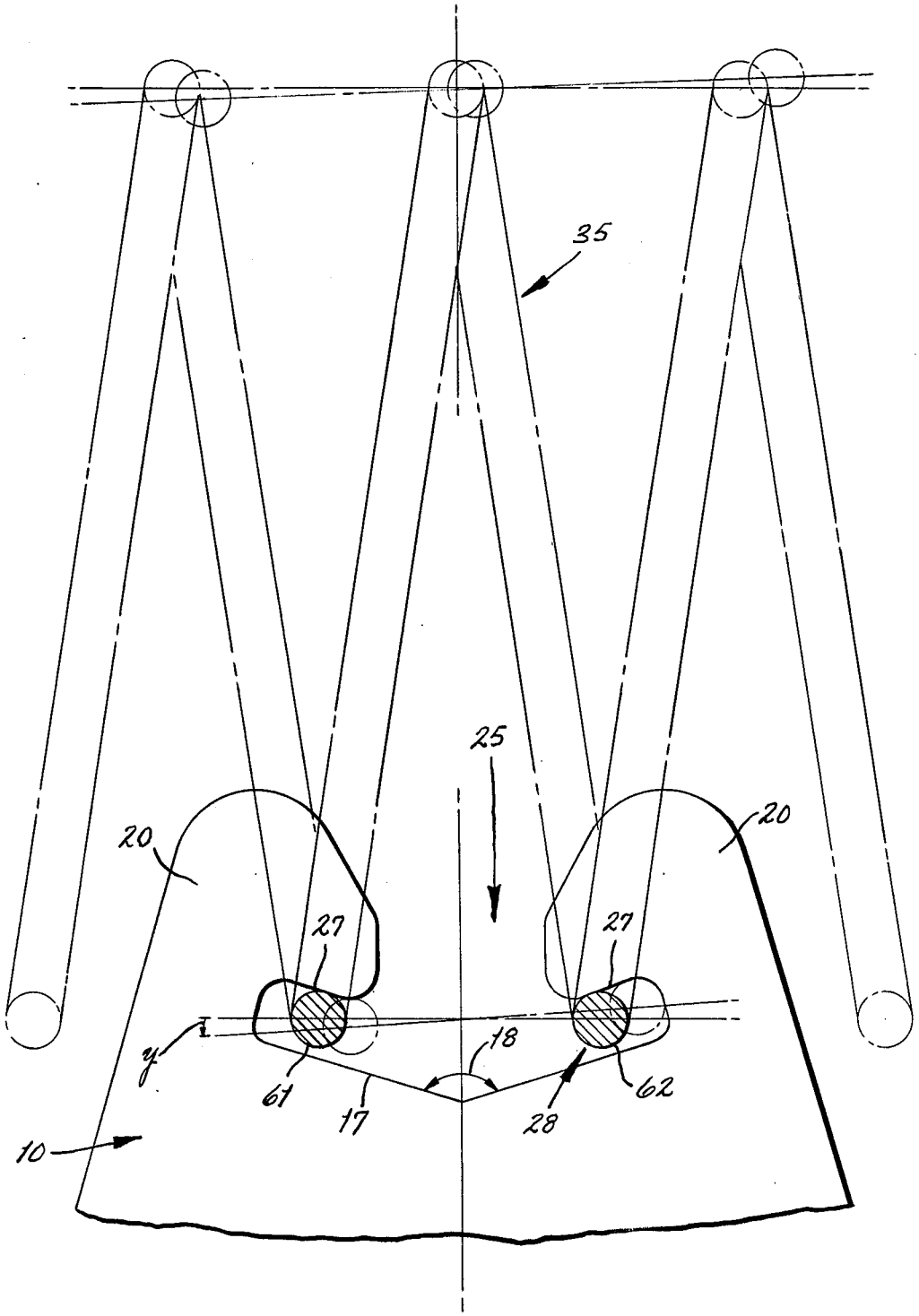
FIG. 4 is an enlarged fragmentary view, partly schematic illustrating how one of the insulators, positioned in the "straight run" portion of a heating coil, protects against escape of coil turns.

FIG. 4 shows schematically how the design of the present insulator 10 affords security in mounting straight run portions of the coils 35. The residual tension which retains the wire coil 35 on the rack assembly 40 cannot be resisted along the axis of a coil, but only along the perimeter. In FIG. 4, the solid lines show adjacent coil turns 61, 62 spaced more closely than the length of the slot portion 28 which is bounded by the hook-like projections 20. For there to be a danger of escape through the throat 25, there must be sideward displacement, shown as taking place to the right. Morever, due to the angle of convergence 18, as the coil turns 61, 62 slide to the right along the hook rear edges 27, the turn 61, which is to be drawn outward to escape through the throat 25, must first move inward toward the linear abutment edge 17 on the left side of the insulator 10 shown, while the turn 62 on the opposite side may deflect outward. The result is to require that, prior to escape, a deflection take place which may be thought of as a reverse twist, deflecting the coil 35 locally through the angle y. A substantially similar, though lesser, deflection is required in directly opposite and adjacent portions of the coil 35 and will be resisted by those forces which tend to hold the coil 35 in its original position.

While FIG. 4 reflects schematically the condition along straightrun portions of the coil 35, conditions conducive to escape of coil turns are likely to be present at both outside 180° bends m and inside 180° bends n. Referring to the left side of FIG. 2, the insulator 10 nearest the left inside bend n does not hold the coil 35 straight; instead the coil passes at a curvature which both lessens the spacing of the coil turns, as compared to those at the extreme left, and imposes an angular component, exerted somewhat to the right, which would tend to draw a coil turn toward the throat 25. Here again the angular convergence of the rear hook edges 27 resists the coil forces by imposing of the requirement of a reverse angular twist comparable to the twist y shown in FIG. 4.

Persons skilled in the art will be aware of other conditions and problems conducive to escape of coils mounted in planes, caused for example by carelessness and mishandling in mounting the coil 35 on the insulators 10.

From this disclosure, variations for meeting such conditions and solving such problems will occur to those skilled in the art.

INDUSTRIAL APPLICABILITY

Heater rack assemblies utilizing the present insulators have a well-established market for use in electric furnaces and other appliances for domestic use.

The embodiments of the invention in which an exclusive property or privilege is claimed are defined as follows:

1. A heater rack assembly, comprising a plurality of insulators, each having a body portion including an inward support part having a transverse axis of symmetry and means along such transverse axis for mounting onto a rack frame, further having a longitudinal axis of symmetry extending perpendicular to such transverse axis, the insulator being substantially planar about the plane defined by the said transverse and longitudinal axes, linear abutment edges, adjacent to and converging at said longitudinal axis of symmetry, whose angle of convergence, directed toward said support part, is substantially 150° or less, the insulator further comprising, commencing at the ends of said linear abutment edges remote from such longitudinal axis of symmetry, hook-like projections extending symmetrically about such longitudinal axis, said hook-like projections having outer edges continuing from the sides of said body portion and sloping toward said longitudinal axis of symmetry and terminating spacedly therefrom in inner edges facing said longitudinal line of symmetry, thereby providing a throat, said hook-like projections further having linear hook rear edges parallel to and spaced from the linear abutment edges of the body portion, whereby their said spacing from the body portion linear abutment edges provides linear slot portions at each side of, and converging at, the said longitudinal line of symmetry at such angle of convergence, within which slot portions to support turns of a coiled wire element on both sides of such transverse axis of symmetry, in combination with a substantially planar frame, means extending thereacross in parallel rows to support said plurality of insulators by their said inward support parts in a common plane defined by the planes of said insulators, and an electrical heating coil having terminal ends and being supported between said terminal ends by said insulators in such common plane in a pattern of parallel rows connected by 180° bends, such support being afforded at adjacent pairs of wire turns of the coil by their being positioned within said linear slot portions of the insulators, whereby the angular convergence of the slot portions requires a reverse twisting displacement, in such common plane, of the coil turns so supported, to permit their escape from a supporting insulator.

* * * * *

UNITED STATES PATENT AND TRADEMARK OFFICE

CERTIFICATE OF CORRECTION

PATENT NO. : 4,481,411

DATED : November 6, 1984

INVENTOR(S) : James E. Roth

It is certified that error appears in the above-identified patent and that said Letters Patent is hereby corrected as shown below:

In col. 1, line 50, "spaced" should be ---mounted---.

In col. 2, line 16, "tends" should be ---bends---.

In col. 4, line 32, "Morever" should be ---However---.

In col. 5, line 20, "or less" should be deleted.

Signed and Sealed this

*Sixteenth* Day of *April 1985*

[SEAL]

*Attest:*

DONALD J. QUIGG

*Attesting Officer* *Acting Commissioner of Patents and Trademarks*